US005520566A

United States Patent [19]

Lin

[11] Patent Number: 5,520,566

[45] Date of Patent: May 28, 1996

[54] STUFFED TOY CAPABLE OF SUSTAINING DIFFERENT POSTURES

[76] Inventor: Lisa Lin, 5F, No. 8, Alley 5, Lane 265, Sec. 4, Hsin-I Rd., Taipei City, Taiwan

[21] Appl. No.: 519,305

[22] Filed: Aug. 25, 1995

[51] Int. Cl.[6] ..... A63H 3/06

[52] U.S. Cl. ..... 446/180; 446/268; 446/369

[58] Field of Search ..... 446/176, 180, 446/183, 199, 198, 268, 320, 369, 385; 137/596.2, 907

[56] References Cited

U.S. PATENT DOCUMENTS

| | | | |
|---|---|---|---|
| 3,238,599 | 3/1966 | Bauman . | |
| 4,576,585 | 3/1986 | Balogh et al. | 446/320 |
| 5,162,013 | 11/1992 | Von Mohr | 446/320 |
| 5,167,561 | 12/1992 | Rizzo | 446/226 |

FOREIGN PATENT DOCUMENTS

| | | | |
|---|---|---|---|
| 206500 | 12/1986 | European Pat. Off. | 446/385 |
| 8118 | 1/1916 | United Kingdom | 446/226 |

OTHER PUBLICATIONS

"Frankenbumps" advertisement, Mego Corp.

*Primary Examiner*—Sam Rimell
*Assistant Examiner*—Jeffrey D. Carlson
*Attorney, Agent, or Firm*—Darby & Darby

[57] ABSTRACT

A stuffed toy includes a toy body, a tubular air control seat and an air extractor. The toy body is made from an air impermeable and stretchable cloth material and confines a hollow space that is stuffed with a solid filling material. The toy body is formed with a tubular connecting portion which defines an opening for accessing the hollow space. The air control seat is made from a pliable and resilient material and is secured in the tubular connecting portion of the toy body. The air control seat has a first tubular part and a second tubular part with a first end connected to the first tubular part and a second end that is formed with a control valve. The air extractor is secured in the first tubular part of the air control seat and is operable so as to draw air from the hollow space of the toy body into the air control seat in order to stiffen the toy body and enable the toy body to sustain a desired posture. The second tubular part of the air control seat is deformable to open the control valve and permit air flow into the hollow space of the toy body to release the toy body from the desired posture.

14 Claims, 9 Drawing Sheets

STUFFED TOY CAPABLE OF SUSTAINING DIFFERENT POSTURES

BACKGROUND OF THE INVENTION

1. Field of the Invention

The invention relates to a stuffed toy, more particularly to a stuffed toy which is capable of sustaining different postures.

2. Description of the Related Art

Conventional stuffed toys are either too flexible, wherein a desired posture cannot be sustained, or too stiff, wherein the posture thereof cannot be changed by the user.

SUMMARY OF THE INVENTION

Therefore, the object of the present invention is to provide a stuffed toy which is capable of sustaining different postures as desired by the user.

Accordingly, the stuffed toy of the present invention comprises a toy body, a tubular air control seat and an air extractor. The toy body is made from an air impermeable and stretchable cloth material and confines a hollow space that is stuffed with a solid filling material. The toy body is formed with a tubular connecting portion which defines an opening for accessing the hollow space. The air control seat is made from a pliable and resilient material and is secured in the tubular connecting portion of the toy body. The air control seat has a first tubular part and a second tubular part with a first end connected to the first tubular part and a second end that is formed with a control valve. The air extractor is secured in the first tubular part of the air control seat and is operable so as to draw air from the hollow space of the toy body into the air control seat in order to stiffen the toy body and enable the toy body to sustain a desired posture. The second tubular part of the air control seat is deformable to open the control valve and permit air flow into the hollow space of the toy body to release the toy body from the desired posture.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
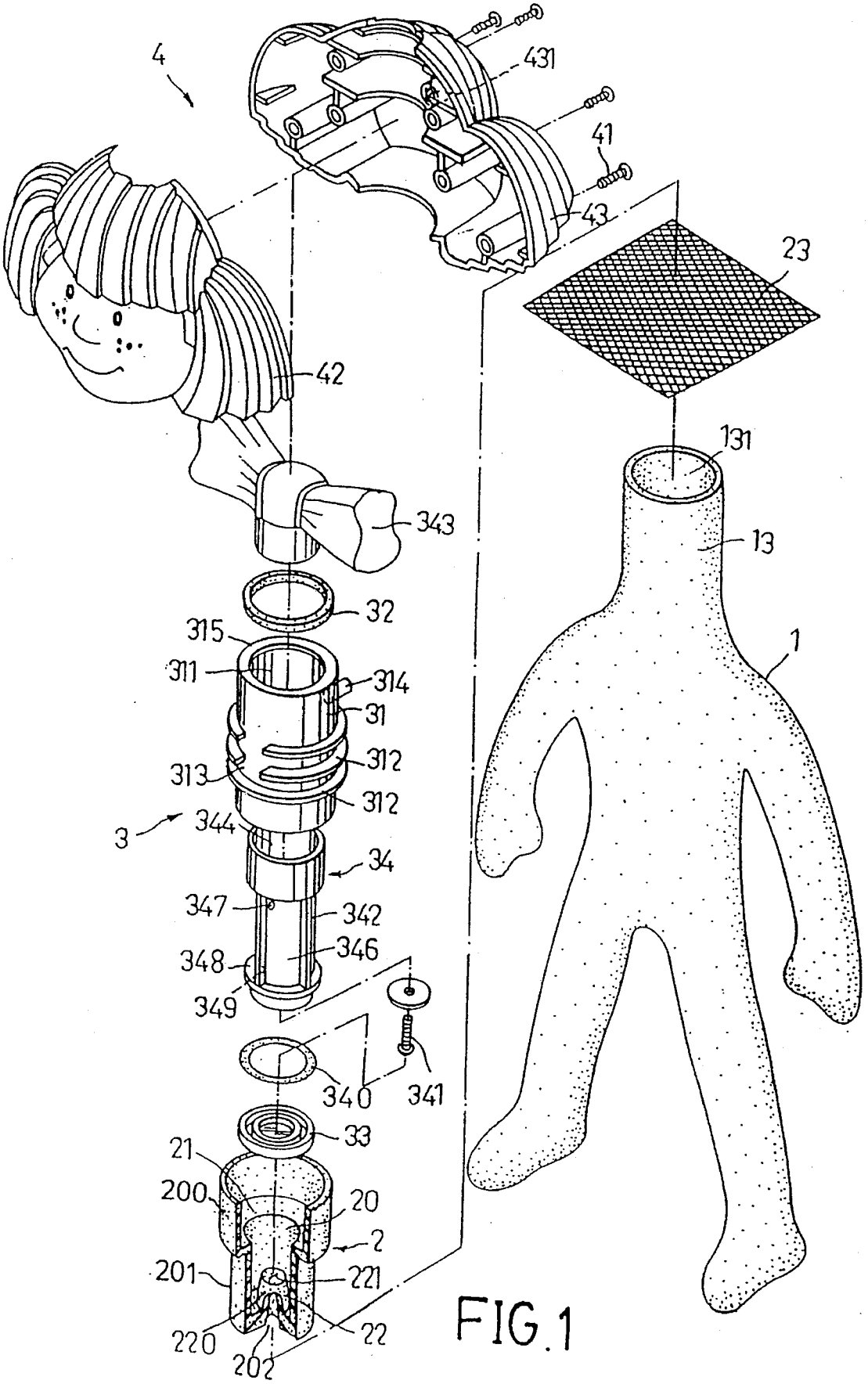
FIG. 1 is an exploded view of the first preferred embodiment of a stuffed toy according to the present invention.
Figure 2:
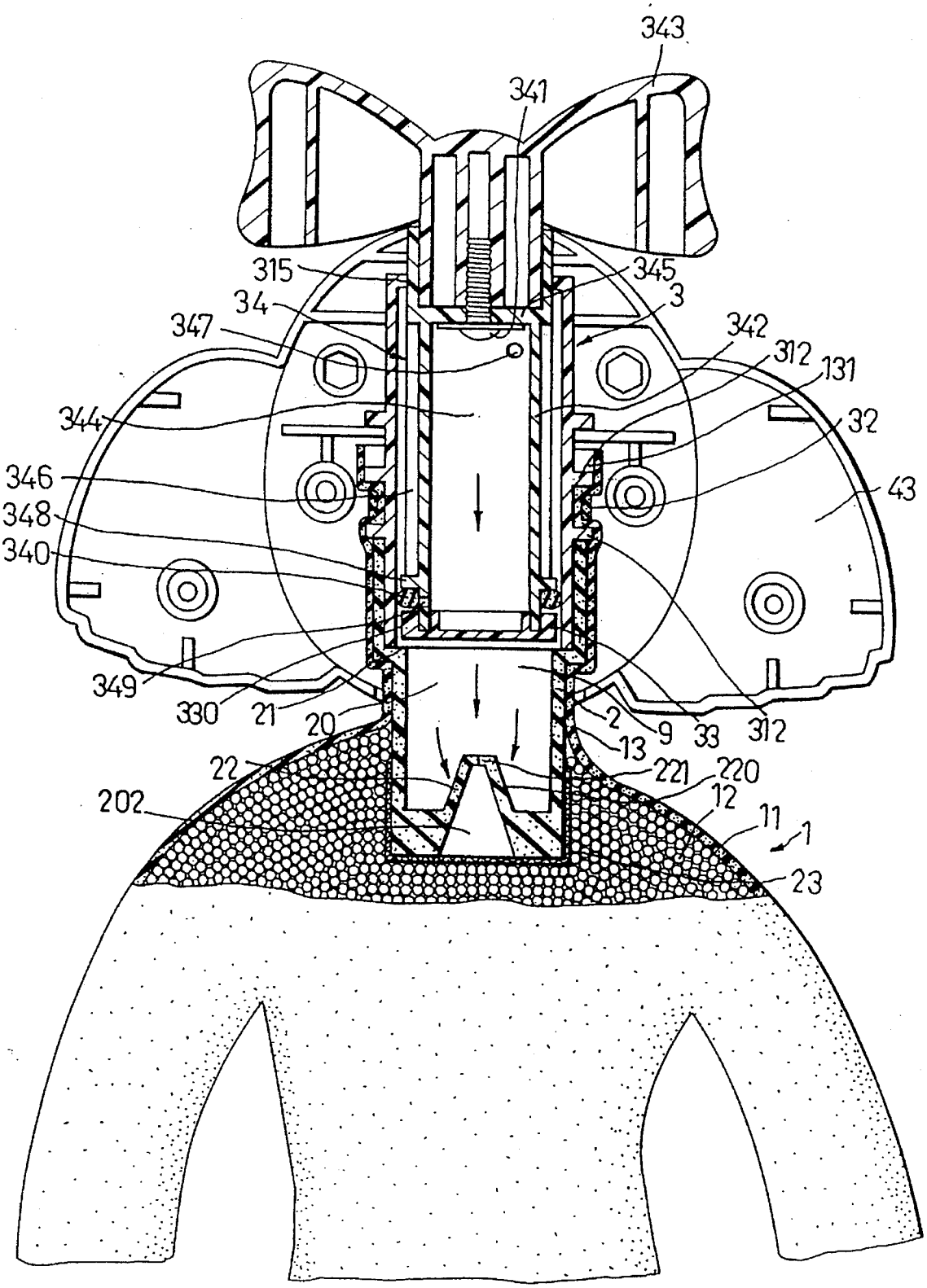
FIG. 2 is a partly sectional view of the first preferred embodiment.

Referring to FIGS. 1 and 2, the first preferred embodiment of a stuffed toy according to the present invention is shown to comprise a toy body 1, a tubular air control seat 2, an air extractor 3, and a casing 4.

The toy body 1 is made from an air impermeable and stretchable cloth material, such as rubber, and confines a hollow space 11 therein. The hollow space 11 is stuffed with a solid filling material 12. The solid filling material 12 is preferably granular, such as plastic grains, rice grains, corn grains and the like. In this embodiment, the toy body 1 is in the form of a doll body. The toy body 1 further has a top end formed with a tubular connecting portion 13 which defines an opening 131 for accessing the hollow space 11.

The air control seat 2 is made from a pliable and resilient material, such as silicone rubber. The air control seat 2 includes a wider first tubular part 200, a narrower second tubular part 201 and an annular shoulder 21 which interconnects the first and second tubular parts 200, 201. The air control seat 2 confines an air chamber 20 therein. The second tubular part 201 has a bottom end that is formed with a hole 202. A hollow projection 22 has a surrounding wall 220 that extends into the second tubular part 201. The surrounding wall 220 has a first end formed with a control valve 221 and a second end that is connected to the bottom end of the second tubular part 201 around the hole 202. The surrounding wall 220 widens gradually from the first end to the second end thereof. The air control seat 2 is to be secured in the tubular connecting portion 13 of the toy body 1. In order to prevent the solid filling material 12 in the hollow space 11 of the toy body 1 from entering into the air chamber 20 via the control valve 221, an air permeable partitioning member 23 is provided at the bottom end of the second tubular part 201. In this embodiment, the partitioning member 23 is a screen cloth formed with tiny air holes.

The air extractor 3 includes a tubular housing 31, an elastic band 32, a cap 33 and an extractor unit 34. The tubular housing 31 is to be inserted into the tubular connecting portion 13 of the toy body 1 such that a lower end portion thereof extends into the first tubular part 200 of the air control seat 2 and rests on the annular shoulder 21. The tubular housing 31 confines an axial through-hole 311 and has an upper end portion formed with a pair of ring projections 312 at an outer wall surface. The ring projections 312 confine an annular groove 313 for receiving the elastic band 32 therein. The upper end portion of the tubular housing 31 further has a radial pin 314 that projects outwardly therefrom, and a radial inward limit flange 315. The extractor unit 34 includes a hollow shaft 342 and a handle 343. The hollow shaft 342 confines an axial air chamber 344 and has a first portion formed with a partition plate 345 and a second portion which extends axially into the tubular housing 31 and which is in sliding contact with the limit flange 315 of the tubular housing 31. The second portion of the hollow shaft 342 has an outer wall surface formed with at least one axially extending recess 346. A radial vent hole 347 fluidly communicates the recess 346 and the air chamber 344. The second portion of the hollow shaft 342 has the cap 33 secured thereon to close one end of the air chamber 344 and is formed with an annular flange 348 that projects radially and outwardly and that is disposed above the cap 33. A sealing ring 340 is disposed around the hollow shaft 342 between the annular flange 348 and the cap 33. The hollow shaft 342 is further formed with a radial air hole 349 between the annular flange 348 and the cap 33. In this embodiment, the handle 343 is in the shape of a ribbon and is mounted on the partition plate 345 by means of a screw fastener 341.

The casing 4 includes complementary front and rear casing parts 42, 43 which are secured to one another by means of mounting units 41, such as screws. In this embodiment, the casing 4 is in the shape of a doll head. Thus, the front casing part 42 serves as the face portion while the rear casing part 43 serves as the back portion of the doll head. The rear casing part 43 is formed with a positioning notch 431 for positioning the radial pin 314 of the tubular housing 31 therein.

Referring again to FIGS. 1 and 2, when assembling the stuffed toy of the first preferred embodiment, the hollow space 11 of the toy body 1 is stuffed with the solid filling material 12, and the hollow shaft 342 of the extractor unit 34 is inserted into the tubular housing 31 via the lower end portion of the latter. The handle 343 is mounted on the partition plate 345 by means of the screw fastener 341, and the sealing ring 340 and the cap 33 are installed on the Second portion of the hollow shaft 342. The sealing ring 340 is in sliding contact with an inner wall surface of the tubular housing 31, while the cap 33 forms a clearance 330 with the inner wall surface of the tubular housing 31. The assembled air extractor 3 is secured in the first tubular part 200 of the air control seat 2 such that the lower end portion of the tubular housing 31 rests on the annular shoulder 21. The cap 33 cooperates with the bottom end of the second tubular part 201 to form a sealed chamber 9 therewith. The partitioning member 23 is then provided at the bottom end of the second tubular part 201, and the assembly of the air control seat 2 and the air extractor 3 is inserted into the tubular connecting portion 13 of the toy body 1 via the opening 131. The elastic band 32 is then provided in the annular groove 313 so as to tie the tubular connecting portion 13 of the toy body 1 to the tubular housing 31 of the air extractor 3. Finally, the rear casing part 43 is disposed on one side of the air extractor 3 such that the radial pin 314 of the tubular housing 31 extends into the positioning notch 431, and the front casing part 42 is secured to the rear casing part 43 by means of the mounting units 41, thereby concealing the tubular housing 31 of the air extractor 3 in the casing 4. The hollow projection 22 in the second tubular part 201 of the air control seat 2, however, should be disposed below the casing 4.

Figure 3:
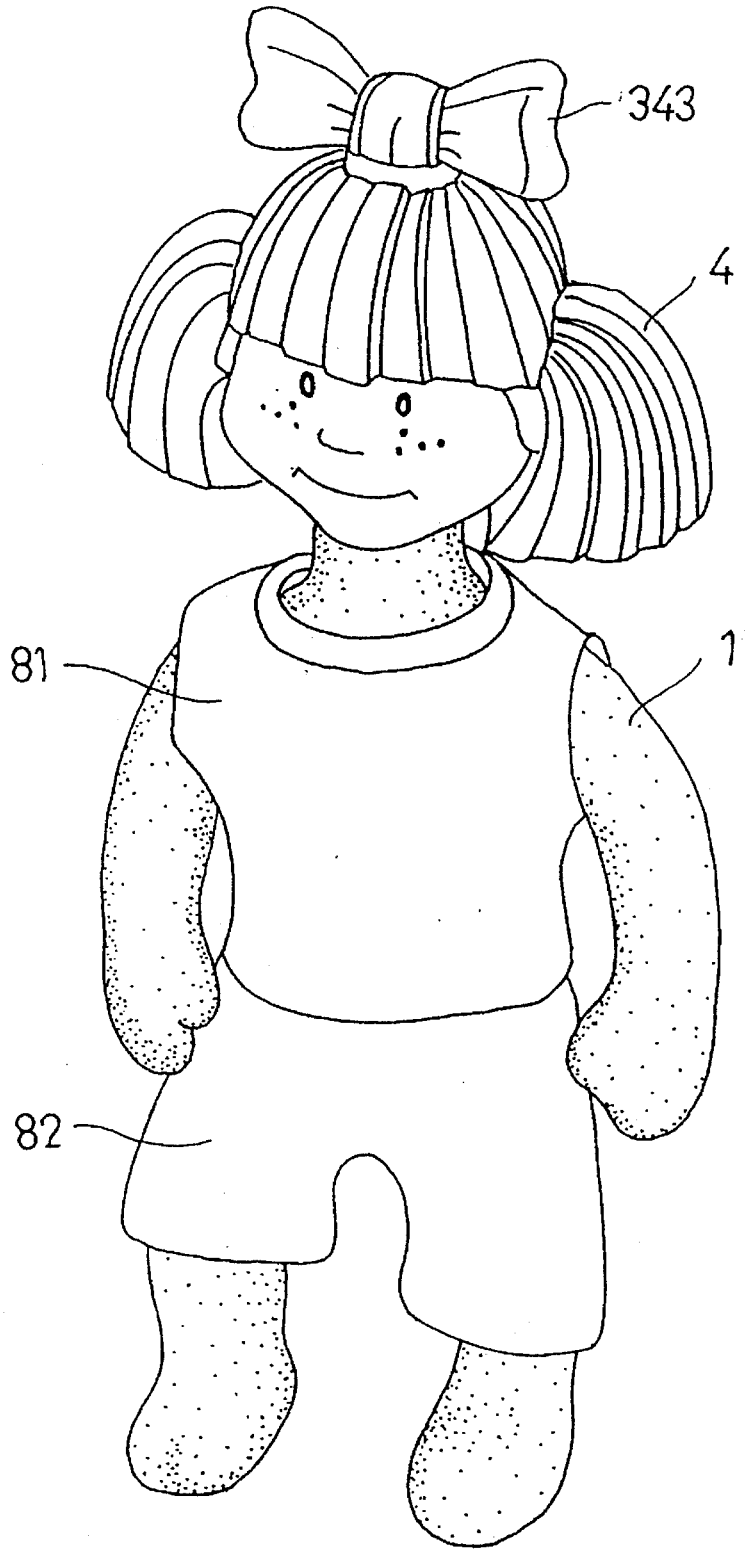
FIG. 3 is a perspective view of the first preferred embodiment when in a flexible state.

FIG. 3 is a perspective view of the first preferred embodiment. As shown, a shirt 81 and a pair of pants 82 are worn on the toy body 1 to enhance appearance of the stuffed toy. Under normal conditions, the hollow space 11 of the toy body 1 has some air contained therein. Thus, the stuffed toy is in a flexible state to permit the user to vary the posture of the same.

Figure 4:
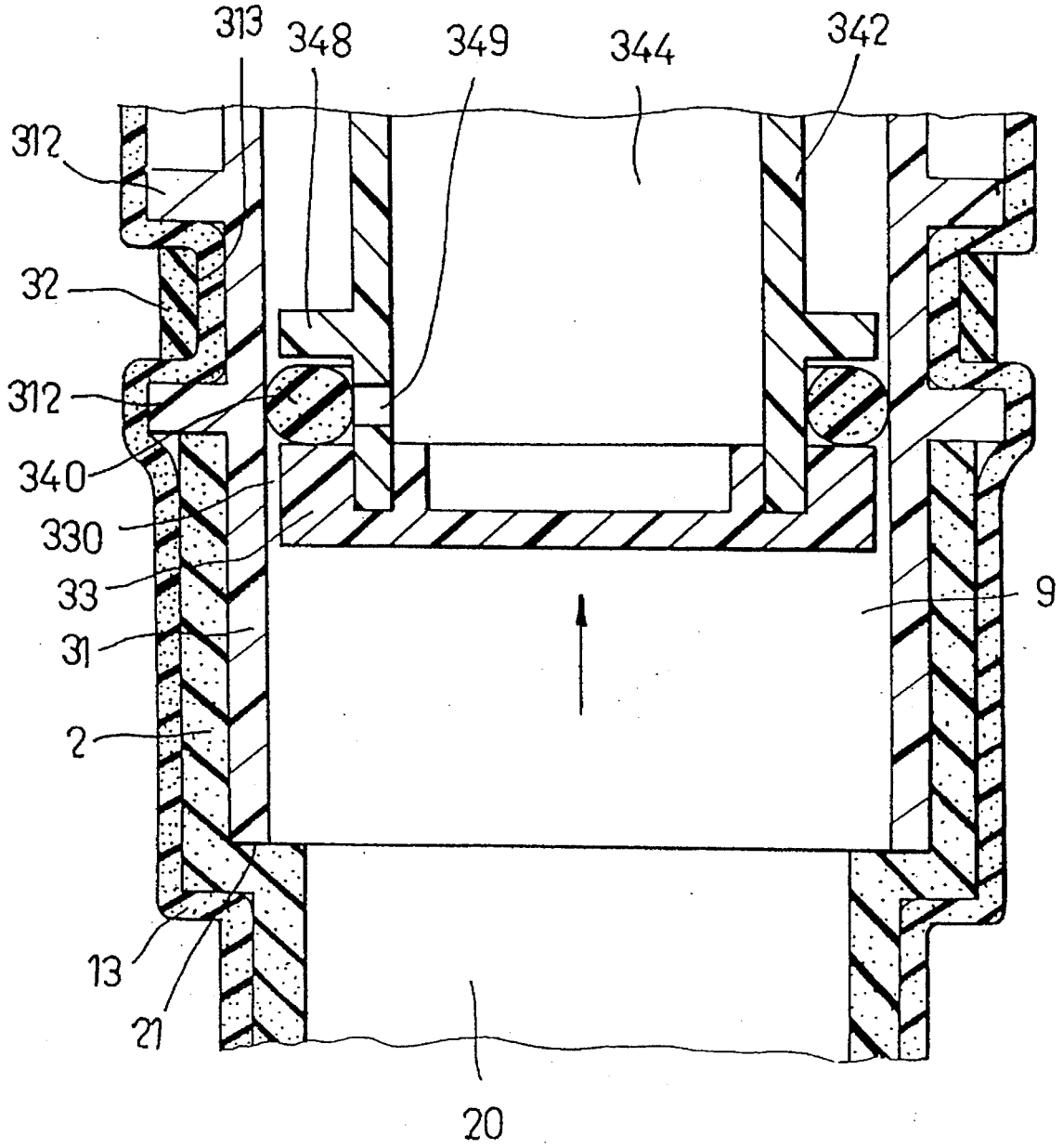
FIG. 4 is an enlarged sectional view illustrating air flow when an extractor unit of an air extractor of the preferred embodiment is pulled outwardly.
Figure 5:
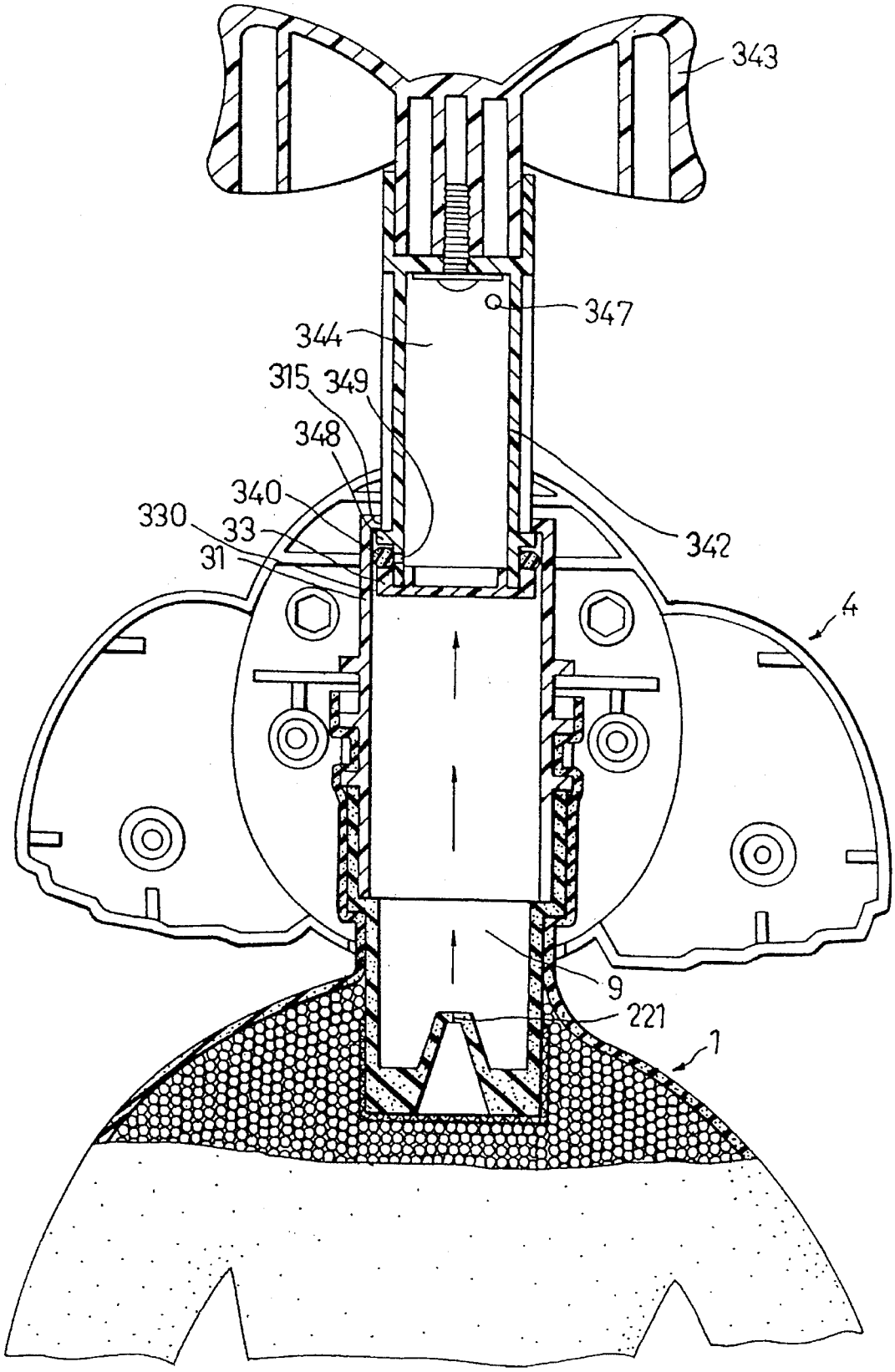
FIG. 5 is a partly sectional view illustrating air flow when the extractor unit of the air extractor of the preferred embodiment is pulled outwardly.

Referring to FIGS. 4 and 5, when it is desired to stiffen the stuffed toy so as to sustain a desired posture, the user uses one hand to hold the stuffed toy at the desired posture, and the other hand to pull the handle 343 of the extractor unit 34 away from the casing 4. Movement of the handle 343 in this direction results in corresponding movement of the hollow shaft 342 to create a suction force in the sealed chamber 9, thereby causing air in the toy body 1 to flow into the sealed chamber 9 via the control valve 221. Movement of the extractor unit 34 is possible until the annular flange 348 thereon abuts the limit flange 315 of the tubular housing 31. As the extractor unit 34 is pulled outwardly, the sealing ring 340, which is in sliding contact with the inner wall surface of the tubular housing 31, deforms and is dragged by the cap 33 to move therewith. The sealing ring 340 blocks the air hole 349 to prevent air in the sealed chamber 9 from flowing into the air chamber 344 of the hollow shaft 342 via the clearance 330 at this time.

Figure 6:
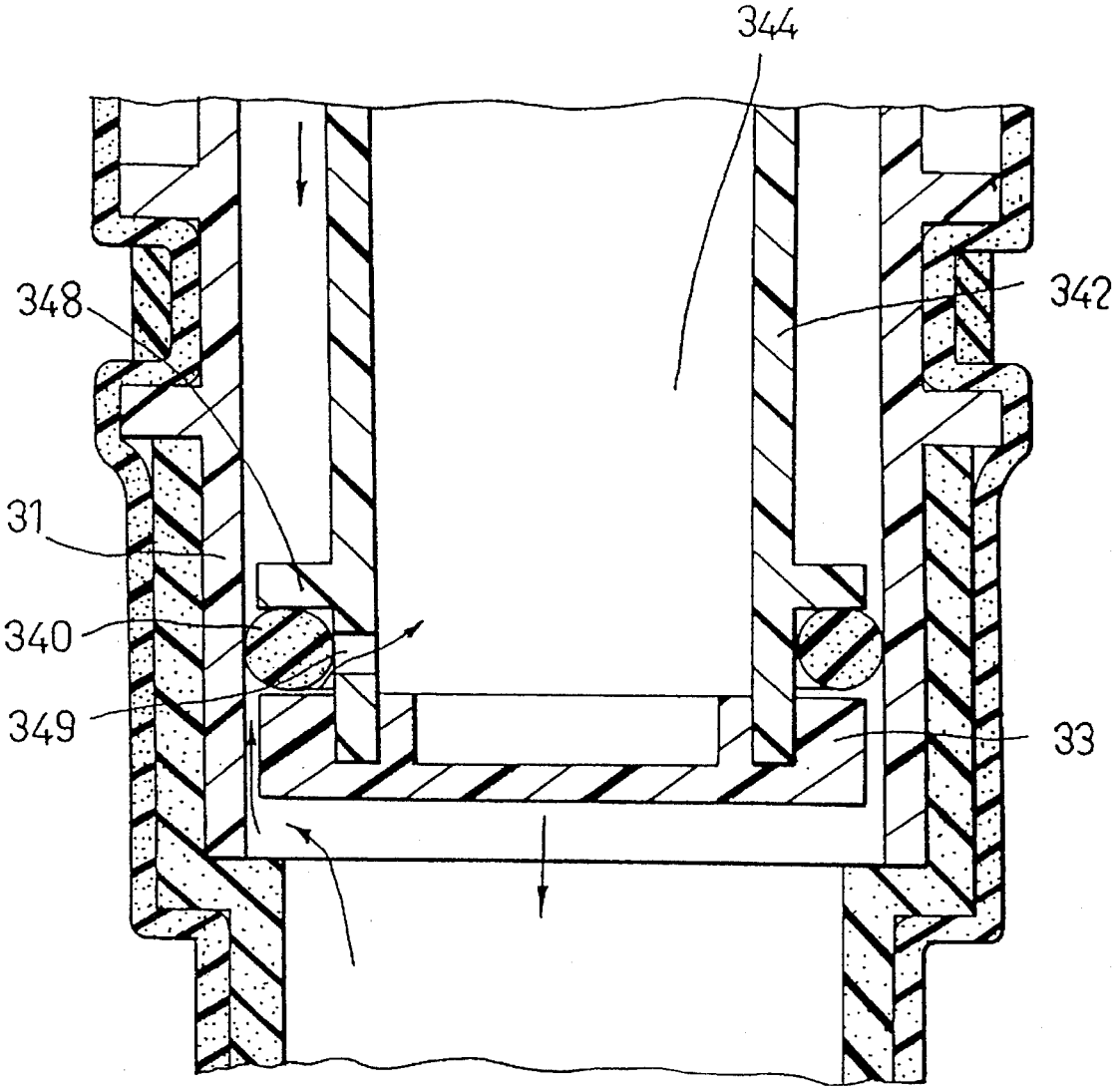
FIG. 6 is an enlarged sectional view illustrating air flow when the extractor unit of the air extractor of the preferred embodiment is pushed inwardly.

Referring to FIGS. 2 and 6, when the handle 343 is pushed toward the casing 4, the sealing ring 340, which remains in sliding contact with the inner wall surface of the tubular housing 31, is pushed by the annular flange 348 and deforms accordingly. The sealing ring 340 does not fully block the air hole 349 at this time, thereby permitting air in the sealed chamber 9 to flow into the air chamber 344 of the hollow shaft 342 via the clearance 330 and the air hole 349. Air in the air chamber 344 is released to the atmosphere via the vent hole 347. At the same time, movement of the hollow shaft 342 in this direction creates a compression force on the hollow projection 22, thereby closing the control valve 221.

Figure 7:
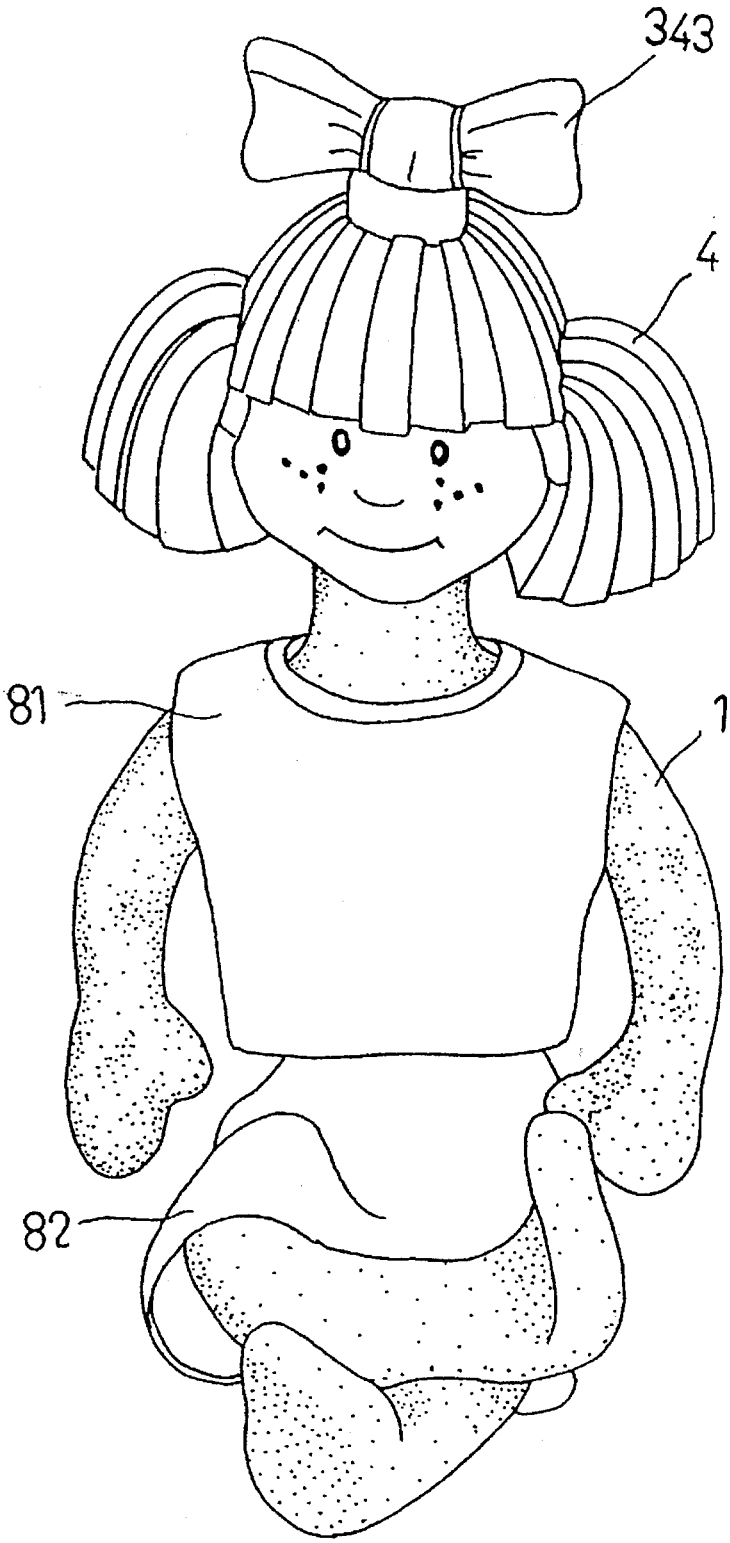
FIG. 7 is a perspective view of the first preferred embodiment when in a stiffened state.

With reference to FIGS. 2, 4, 5, and 6, repeated pulling and pushing of the handle 343 of the extractor unit 34 results in the removal of air from the hollow space 11 of the toy body 1. After the air in the hollow space 11 has been removed and only the solid filling material 12 remains, the toy body 1 becomes stiff, thereby enabling the latter to sustain the desired posture, as shown in FIG. 7.

Figure 8:
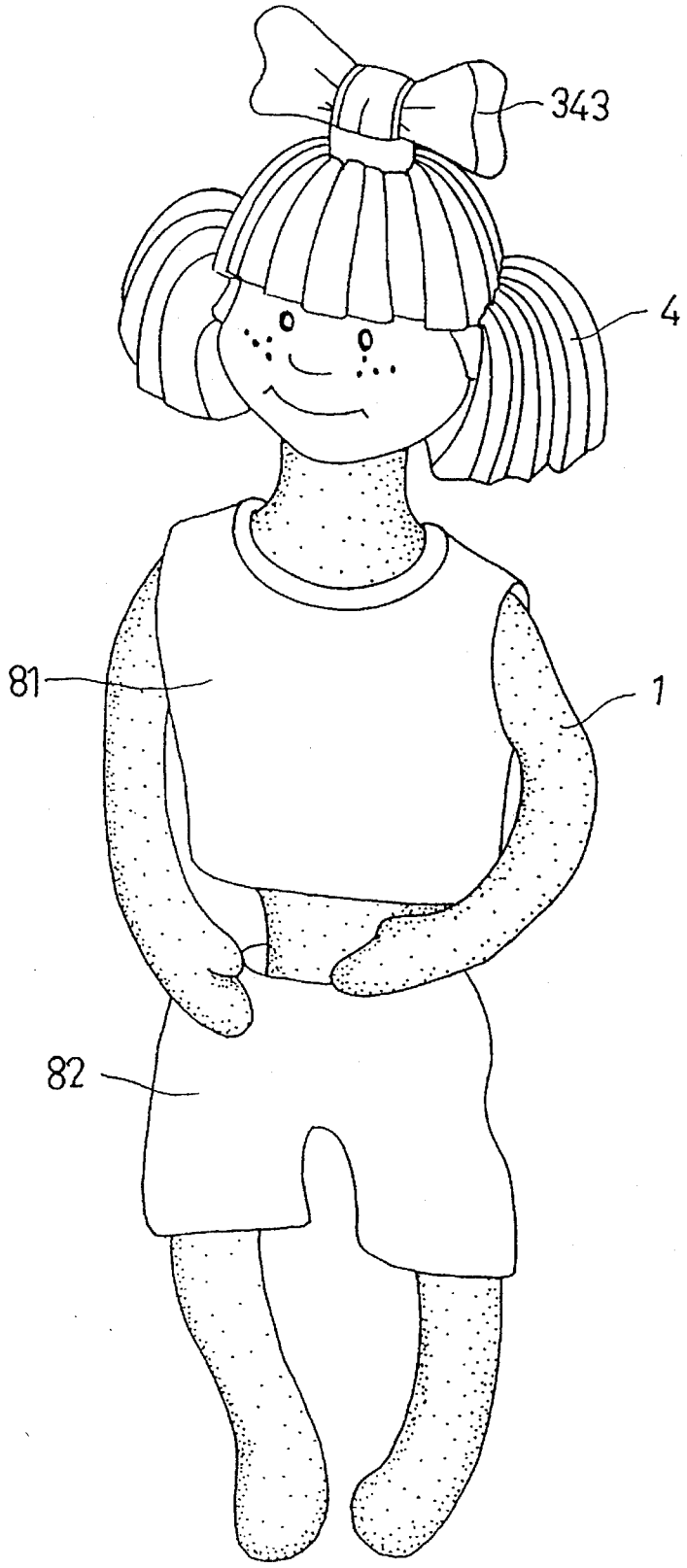
FIG. 8 is another perspective view of the first preferred embodiment when in a stiffened state, the posture of the stuffed toy being different from that shown in FIG. 7.

In order for the stuffed toy to revert to the flexible state, the user presses the part of the toy body 1 which is immediately below the casing 4, thereby deforming the hollow projection 22 of the air control seat 2 to open the control valve 221. Air enters into the hollow space 11 of the toy body 1 via the vent hole 347, the air chamber 344, the air hole 349, the clearance 330, the air chamber 20 and the control valve 221 to release the toy body 1 from the previous posture, as shown in FIG. 3. At this time, the posture of the stuffed toy may be changed to that shown in FIG. 8, and repeated pulling and pushing of the extractor unit 34 may be performed to once more remove air from the hollow space 11 of the toy body 1 in order to enable the latter to sustain the new posture.

Figure 9:
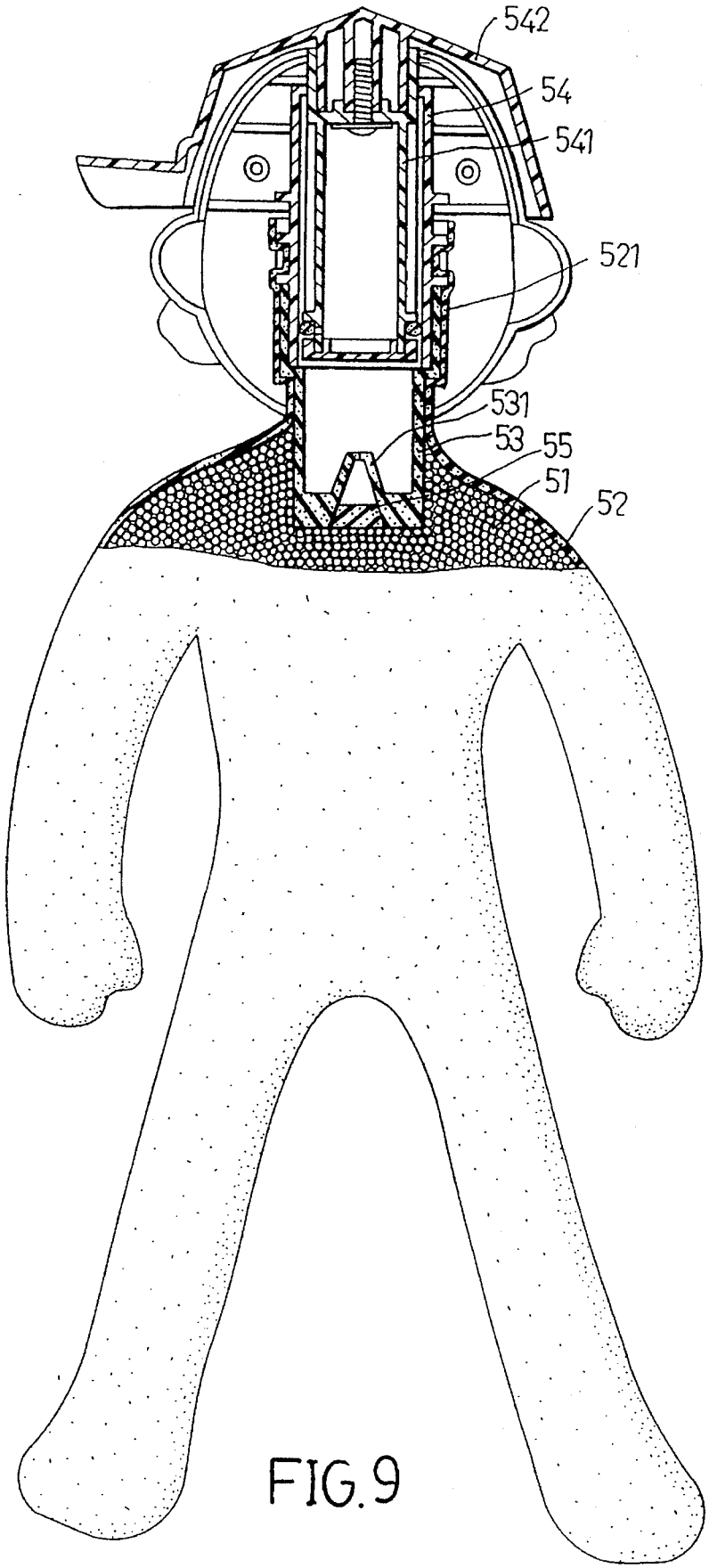
FIG. 9 is a partly sectional view of the second preferred embodiment of a stuffed toy according to the present invention.

FIG. 9 illustrates the second preferred embodiment of a stuffed toy according to the present invention. As shown, the second preferred embodiment similarly comprises a toy body 52 stuffed with a solid filling material 51, an air control seat 53 secured in a tubular connecting portion 521 of the toy body 52, and an air extractor 54 extending into the air control seat 53. The main differences between the first and second preferred embodiments reside in that the partitioning, member 55 of the air control seat 53 is a block of sponge and is installed below the hollow protrusion 531 of the air control seat 53. In addition, the handle 542, which is attached to the hollow shaft 541 of the extractor unit 54, is in the form of a baseball cap. The operation of the second preferred embodiment is similar to that of the previous embodiment and will not be detailed further.

It should be noted that the shape of the toy body should not be limited to those of the first and second preferred embodiments. Other shapes, such as those of animals and cartoon characters, may be used. In addition, the design of the handle of the extractor unit is chosen in accordance with the shape of the toy body to further enhance the appearance of the stuffed toy of the present invention.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A stuffed toy comprising:

a toy body made from an air impermeable and stretchable cloth material and confining a hollow space that is stuffed with a solid filling material, said toy body being formed with a tubular connecting portion which defines an opening for accessing said hollow space;

a tubular air control seat made from a pliable and resilient material, said air control seat being secured in said tubular connecting portion of said toy body and having a first tubular part and a second tubular part with a first end connected to said first tubular part and a second end that is formed with a control valve; and an air extractor secured in said first tubular part of said air control seat and operable so as to draw air from said hollow space of said toy body into said air control seat in order to stiffen said toy body and enable said toy body to sustain a desired posture;

whereby, said second tubular part of said air control seat is deformable to open said control valve and permit air flow into said hollow space of said toy body to release said toy body from the desired posture.

2. The stuffed toy as claimed in claim 1, wherein said air extractor comprises:

a tubular housing having a first end portion which extends into said first tubular part of said air control seat and a second end portion which is formed with a radial inward limit flange; and an extractor unit including a hollow shaft with a first portion and a second portion which extends axially into said tubular housing, and a handle mounted on said first portion of said hollow shaft, said hollow shaft confining an axial air chamber and being in sliding contact with said limit flange of said tubular housing, said hollow shaft being formed with a radial vent hole, said second portion of said hollow shaft having a cap secured thereon to close one end of said air chamber and being formed With an annular flange that projects radially and outwardly and that is disposed above said cap, said cap forming a clearance with an inner wall surface of said tubular housing, said hollow shaft being formed with a radial air hole between said annular flange and said cap and having a sealing ring disposed therearound between said annular flange and said cap, said sealing ring being in sliding contact with the inner wall surface of said tubular housing, said sealing ring blocking said air hole to prevent air in said air control seat from flowing into said air chamber of said hollow shaft via said clearance when said extractor unit is pulled outwardly from said tubular housing so as to draw the air from said hollow space of said toy body into said air control seat, said sealing ring permitting the air in said air control seat to flow into said air chamber of said hollow shaft via said clearance and said air hole when said extractor unit is pushed inwardly toward said tubular housing so as to expel the air in said air control seat.

3. The stuffed toy as claimed in claim 2, wherein said second end portion of said tubular housing has an outer wall surface formed with an annular groove, said second end portion of said tubular housing extending partially into said tubular connecting portion of said toy body, said air extractor further comprising an elastic band provided in said annular groove so as to tie said tubular connecting portion of said toy body to said tubular housing of said air extractor.

4. The stuffed toy as claimed in claim 2, wherein said first tubular part of said air control seat is wider than said second tubular part thereof, said air control seat further having an annular shoulder which interconnects said first and second tubular parts, said first end portion of said tubular housing resting on said annular shoulder.

5. The stuffed toy as claimed in claim 1, wherein said second end of said second tubular part is formed with a hole and a hollow projection which has a surrounding wall that extends into said second tubular part, said surrounding wall having a first end formed with said control valve and a second end that is connected to said second end of said second tubular part around said hole.

6. The stuffed toy as claimed in claim 5, wherein said surrounding wall widens gradually from said first end to said second end thereof.

7. The stuffed toy as claimed in claim 5, further comprising an air permeable partitioning member provided at said second end of said second tubular part to prevent said solid filling material in said hollow space of said toy body from entering into said air control seat via said control valve.

8. The stuffed toy as claimed in claim 7, wherein said partitioning member is a screen cloth formed with tiny air holes.

9. The stuffed toy as claimed in claim 7, wherein said partitioning member is a block of sponge.

10. The stuffed toy as claimed in claim 2, further comprising a casing for concealing said tubular housing of said air extractor therein.

11. The stuffed toy as claimed in claim 10, wherein said casing includes complementary front and rear casing parts which are secured to one another.

12. The stuffed toy as claimed in claim 11, wherein said tubular housing is formed with a radial pin, one of said front and rear casing parts being formed with a positioning notch for positioning said radial pin therein.

13. The stuffed toy as claimed in claim 1, wherein said solid filling material is granular.

14. The stuffed toy as claimed in claim 1, wherein said pliable and resilient material is silicone rubber.

* * * * *